US008355017B2

(12) United States Patent
Tomioka et al.

(10) Patent No.: US 8,355,017 B2
(45) Date of Patent: Jan. 15, 2013

(54) PLASMA DISPLAY DEVICE AND PLASMA DISPLAY PANEL DRIVE METHOD

(75) Inventors: Naoyuki Tomioka, Osaka (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 12/812,151

(22) PCT Filed: Mar. 27, 2009

(86) PCT No.: PCT/JP2009/001398

§ 371 (c)(1),
(2), (4) Date: Jul. 8, 2010

(87) PCT Pub. No.: WO2009/122690

PCT Pub. Date: Oct. 8, 2009

(65) Prior Publication Data

US 2010/0277465 A1 Nov. 4, 2010

(30) Foreign Application Priority Data

Apr. 1, 2008 (JP) ..... 2008-094660

(51) Int. Cl.
*G09G 5/00* (2006.01)
*G09G 3/28* (2006.01)
*G06F 3/038* (2006.01)

(52) U.S. Cl. ..... 345/213; 345/61

(58) Field of Classification Search ..... 345/60–68
See application file for complete search history.

(56) References Cited

U.S. PATENT DOCUMENTS 6,633,268 B2 10/2003 Kougami
7,561,120 B2 7/2009 Lee
7,561,122 B2 7/2009 Choi
7,642,992 B2 1/2010 Rhee et al.
7,907,103 B2 3/2011 Jung
7,969,386 B2 6/2011 Jung
(Continued)

FOREIGN PATENT DOCUMENTS

CN 1619622 A 5/2005
(Continued)

OTHER PUBLICATIONS

South Korea Office Action for 10-2010-7021852, Aug. 18, 2011.
(Continued)

*Primary Examiner* — Joseph Haley
*Assistant Examiner* — Nicholas Lee
(74) *Attorney, Agent, or Firm* — RatnerPrestia

(57) ABSTRACT

The wall charge is appropriately adjusted in the initializing period, and occurrence of an abnormal discharge and an unlit cell is suppressed in the address period. Therefore, a plasma display device has a plasma display panel having a plurality of discharge cells including a display electrode pair that is formed of a scan electrode and a sustain electrode, and a scan electrode driving circuit. The scan electrode driving circuit disposes a plurality of subfields having an initializing period, an address period, and a sustain period in one field, generates a decreasing down-ramp voltage in the initializing period, and generates a negative scan pulse voltage and applies it to the scan electrodes in the address period. In the initializing period, after the generation of the down-ramp voltage, the scan electrode driving circuit generates negative pulse voltage lower than the minimum voltage of the down-ramp voltage and applies it to the scan electrodes.

2 Claims, 9 Drawing Sheets

U.S. PATENT DOCUMENTS

| | | | | |
|---|---|---|---|---|
| 2002/0109650 | A1 | 8/2002 | Kougami et al. | |
| 2005/0116895 | A1 | 6/2005 | Lee et al. | |
| 2006/0262044 | A1 | 11/2006 | Lee | |
| 2006/0279479 | A1 | 12/2006 | Jung | |
| 2007/0008245 | A1* | 1/2007 | Rhee et al. | 345/67 |
| 2007/0063926 | A1 | 3/2007 | Jung et al. | |
| 2007/0109224 | A1 | 5/2007 | Choi et al. | |

FOREIGN PATENT DOCUMENTS

| | | | |
|---|---|---|---|
| CN | 1892758 | A | 1/2007 |
| CN | 1967638 | A | 5/2007 |
| JP | 2000-242224 | A | 9/2000 |
| JP | 2001-184023 | A | 7/2001 |
| JP | 2002-244613 | A | 8/2002 |
| JP | 2002244613 | A | 8/2002 |
| JP | 2005-157372 | A | 6/2005 |
| JP | 2005157372 | A | 6/2005 |
| JP | 2005-326612 | A | 11/2005 |
| JP | 2006-323343 | A | 11/2006 |
| JP | 2006323343 | A | 11/2006 |
| JP | 2006350330 | A | 12/2006 |
| JP | 2007-017938 | A | 1/2007 |
| JP | 2007-17938 | A | 1/2007 |
| JP | 2007-086741 | A | 4/2007 |
| JP | 200786741 | A | 4/2007 |
| JP | 2007-140434 | A | 6/2007 |
| JP | 2007140434 | A | 6/2007 |

OTHER PUBLICATIONS

International Search Report for PCT/JP2009/001398, Jun. 23, 2009.
South Korea Office Action for 519980652221, Aug. 18, 2011.
CN Office Action for 200980109123.6, Aug. 23, 2012.

* cited by examiner

PLASMA DISPLAY DEVICE AND PLASMA DISPLAY PANEL DRIVE METHOD

TECHNICAL FIELD

The present invention relates to a plasma display device used in a wall-mounted television or a large monitor, and a driving method for a plasma display panel.

BACKGROUND ART

A typical alternating-current surface discharge type panel used as a plasma display panel (hereinafter referred to as "panel") has many discharge cells between a front plate and a back plate that are faced to each other. The front plate has the following elements:

a plurality of display electrode pairs disposed in parallel on a front glass substrate; and a dielectric layer and a protective layer for covering the display electrode pairs.

Here, each display electrode pair is formed of a pair of scan electrode and sustain electrode. The back plate has the following elements:

a plurality of data electrodes disposed in parallel on a back glass substrate;

a dielectric layer for covering the data electrodes;

a plurality of barrier ribs disposed on the dielectric layer in parallel with the data electrodes; and phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas containing xenon with a partial pressure of 5%, for example, is filled into a discharge space in the sealed product. Discharge cells are disposed in intersecting parts of the display electrode pairs and the data electrodes. In the panel having this structure, ultraviolet rays are emitted by gas discharge in each discharge cell. The ultraviolet rays excite respective phosphors of red (R), green (G), and blue (B) to emit light, and thus provide color display.

A subfield method is generally used as a method of driving the panel. In this method, one field is divided into a plurality of subfields, and light is emitted or light is not emitted in each discharge cell in each subfield, thereby performing gradation display. Each subfield has an initializing period, an address period, and a sustain period.

In the initializing period, an initializing waveform is applied to each scan electrode, and initializing discharge is caused in each discharge cell. Thus, wall charge required for a subsequent address operation is formed on each discharge cell.

In the address period, a scan pulse is sequentially applied to scan electrodes (hereinafter, this operation is referred to as "scan"), and an address pulse corresponding to an image signal to be displayed is applied to data electrodes (hereinafter, this operation is referred to as "address"). Thus, address discharge is selectively caused between the scan electrodes and the data electrodes, thereby selectively producing wall charge.

In a subsequent sustain period, as many sustain pulses as a predetermined number corresponding to the luminance to be displayed are alternately applied to the display electrode pairs formed of the scan electrodes and the sustain electrodes. Thus, discharge is selectively caused in the discharge cell where wall charge has been produced by address discharge, thereby emitting light in this discharge cell. Image display is thus performed.

The plurality of scan electrodes are driven by a scan electrode driving circuit, the sustain electrodes are driven by a sustain electrode driving circuit, and the data electrodes are driven by a data electrode driving circuit.

As one example of the subfield method, the following driving method is disclosed. Initializing discharge is caused using a gently varying voltage waveform, initializing discharge is selectively caused in the discharge cell having undergone sustain discharge, and thus the light emission related no gradation display is minimized to improve the contrast ratio.

Specifically, in the initializing period of one of a plurality of subfields, the all-cell initializing operation of causing initializing discharge in all discharge cells is performed. In the initializing period of other subfields, the selective initializing operation of causing initializing discharge only in the discharge cell that has undergone sustain discharge in the immediately preceding sustain period is performed. As a result, light emission that is not related to the display is only light emission following the discharge of all-cell initializing operation, thereby allowing image display of sharp contrast (for example, patent literature 1).

Thanks to such driving, the luminance (hereinafter referred to as "luminance of black level") in a black display region that is varied by light emission related to no image display is determined only by weak light emission in the all-cell initializing operation, and image display of sharp contrast is allowed.

A technology of stabilizing the initializing discharge is disclosed. In this technology, in the initializing period, positive voltage is applied to scan electrodes, and then negative voltage is applied to the scan electrodes for a period shorter than the period when the positive voltage is applied. Then, erasing discharge is caused in the discharge cell where positive abnormal wall charge is accumulated on the scan electrode, and abnormal wall charge is erased. Thus, the initializing discharge is stabilized (for example, patent literature 2). When new discharge is caused in order to adjust the wall charge after the initializing discharge, however, problems such as increase in power consumption and degradation of luminance of black level occur.

Recently, the definition of the panel has been further improved. However, in the discharge cell fined in response to improvement in definition of the panel, it is recognized that a phenomenon called "charge decreasing" is apt to occur. In this phenomenon, the wall charge produced in the discharge cell by the initializing discharge is lost.

When excessive wall charge is accumulated in the initializing period, however, strong address discharge occurs in the subsequent address period. It is recognized that the wall charge decreases due to the address discharge occurring in other discharge cells. When strong address discharge occurs in a certain discharge cell, much wall charge is lost and a discharge failure can occur during address operation in the discharge cells adjacent to the certain discharge cell.

While, when the wall charge accumulated in the initializing period is insufficient, a phenomenon (unlit cell) occurs where address discharge itself does not occur and light emission does not occur in a discharge cell to emit light.

Therefore, in order to cause stable address discharge, it is important to appropriately adjust the wall charge in the initializing operation.

Patent Literature 1 Unexamined Japanese Patent Publication No. 2000-242224

Patent Literature 2 Unexamined Japanese Patent Publication No. 2005-326612

SUMMARY OF THE INVENTION

The plasma display device of the present invention has the following elements:

a panel that is driven by a subfield method where a plurality of subfields having an initializing period, an address period, and a sustain period are disposed in one field, and has a plurality of discharge cells including a display electrode pair that is formed of a scan electrode and a sustain electrode; and a scan electrode driving circuit for generating a decreasing down-ramp voltage in the initializing period, and generating negative scan pulse voltage and applying it to the scan electrode in the address period. In the initializing period, after generation of the down-ramp voltage, the scan electrode driving circuit generates negative pulse voltage lower than the minimum voltage of the down-ramp voltage and applies it to the scan electrode.

Thus, the wall charge can be appropriately adjusted in the initializing period. Even in the panel of high definition, therefore, occurrence of an abnormal discharge and an unlit cell is suppressed in the address period, stable address operation can be performed, and the image display quality of the panel can be improved.

REFERENCE MARKS IN THE DRAWINGS

Figure 1:
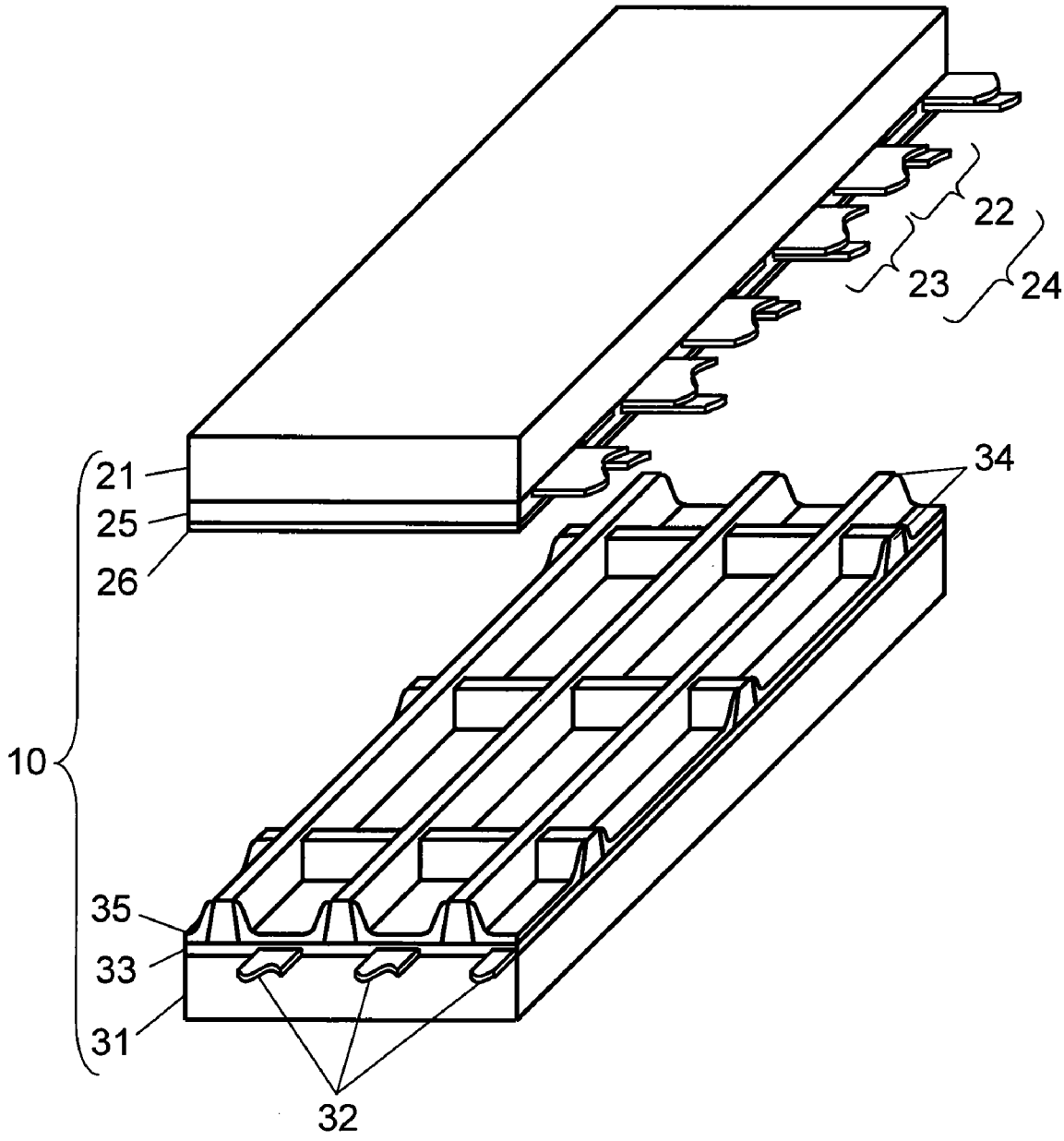
FIG. 1 is an exploded perspective view showing a structure of a panel in accordance with an exemplary embodiment of the present invention.

1 plasma display device
10 panel
21 front plate
22 scan electrode
23 sustain electrode
24 display electrode pair
25, 33 dielectric layer
26 protective layer
31 back plate
32 data electrode
34 barrier rib
35 phosphor layer
41 image signal processing circuit
42 data electrode driving circuit
43 scan electrode driving circuit
44 sustain electrode driving circuit
45 timing generating circuit
50 sustain pulse generating circuit
51 initializing waveform generating circuit
52 scan pulse generating circuit
53, 54 Miller integrating circuit
56 scan integrated circuit (IC)
CP1 comparator
AG1 AND gate
C1, C2, C32 capacitor
Q1, Q2, Q4, Q5 switching element
R1, R2 resistor
D35 diode

DETAILED DESCRIPTION OF PREFERRED EMBODIMENTS

A plasma display device in accordance with an exemplary embodiment of the present invention will be described hereinafter with reference to the accompanying drawings.

Exemplary Embodiment

FIG. 1 is an exploded perspective view showing a structure of panel 10 in accordance with the exemplary embodiment of the present invention. A plurality of display electrode pairs 24 formed of scan electrodes 22 and sustain electrodes 23 are disposed on glass-made front plate 21. Dielectric layer 25 is formed so as to cover scan electrodes 22 and sustain electrodes 23, and protective layer 26 is formed on dielectric layer 25.

Protective layer 26 is made of a material mainly made of MgO. This material is actually used as a material of the panel in order to reduce the discharge start voltage in a discharge cell, and has a large secondary electron discharge coefficient and high durability when neon (Ne) and xenon (Xe) gases are filled.

A plurality of data electrodes 32 are formed on back plate 31, dielectric layer 33 is formed so as to cover data electrodes 32, and mesh barrier ribs 34 are formed on dielectric layer 33. Phosphor layers 35 for emitting lights of respective colors of red (R), green (G), and blue (B) are formed on the side surfaces of barrier ribs 34 and on dielectric layer 33.

Front plate 21 and back plate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon as discharge gas. In the present embodiment, discharge gas where xenon partial pressure is set at about 10% is employed for improving the luminous efficiency. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may be a structure having striped barrier ribs, for example. The mixing ratio of the discharge gas is not limited to the above-mentioned numerical value, but may be another mixing ratio.

Figure 2:
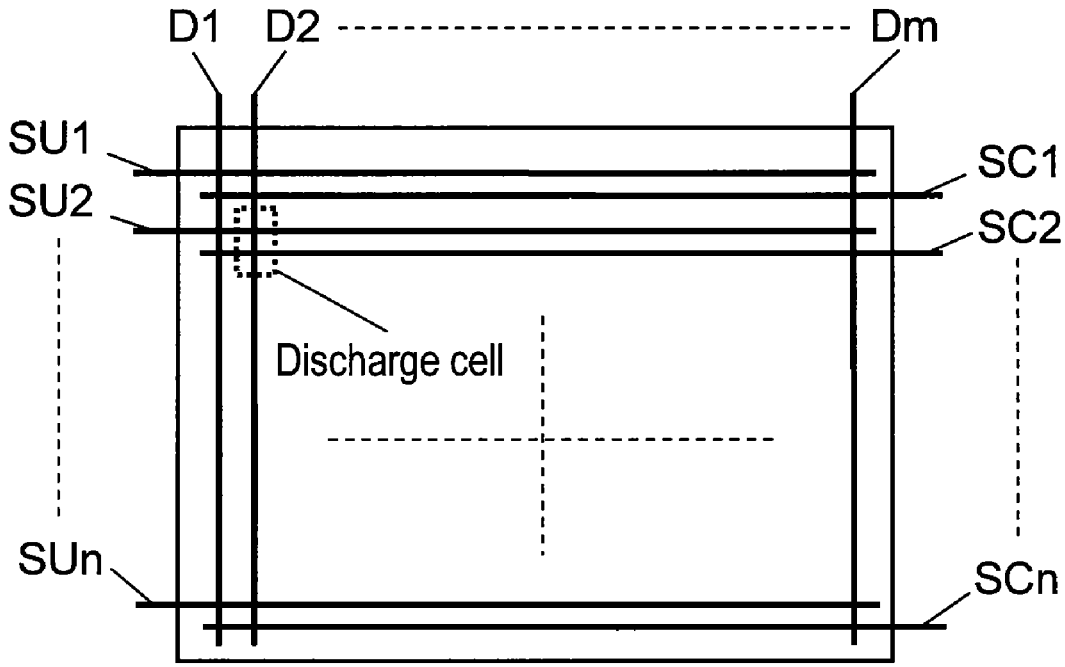
FIG. 2 is an electrode array diagram of the panel.

FIG. 2 is an electrode array diagram of panel 10 in accordance with the exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both extended in the row direction, and m data electrode D1 through data electrode Dm (data electrodes 32 in FIG. 1) extended in the column direction. A discharge cell is formed in the part where a pair of scan electrode SCi (i is 1 through n) and sustain electrode SUi intersect with one data electrode Dj (j is 1 through m). Thus, m×n discharge cells are formed in the discharge space. The region where m×n discharge cells are formed becomes a display region of panel 10.

Figure 3:
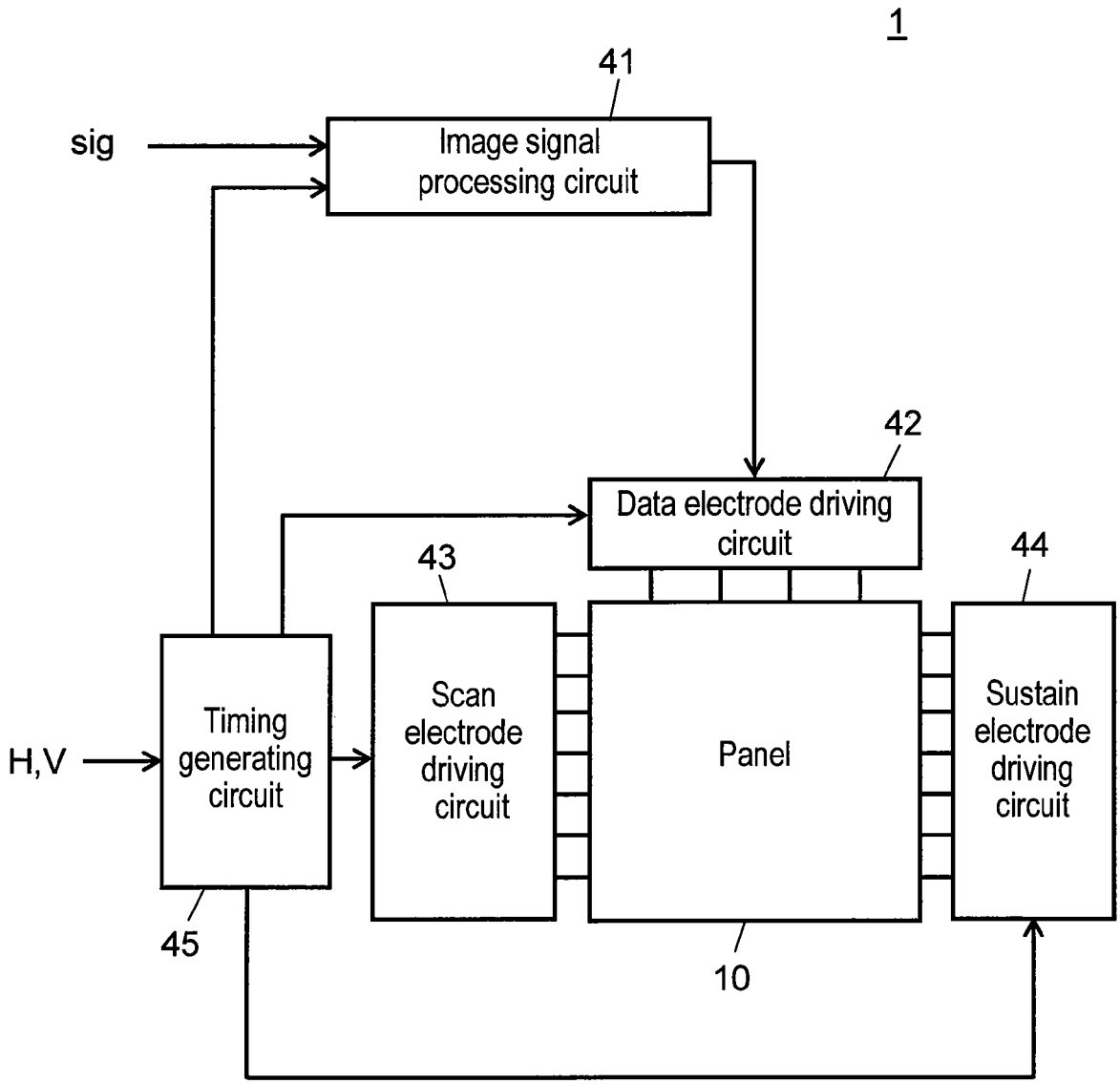
FIG. 3 is a circuit block diagram of a plasma display device in accordance with the exemplary embodiment.

Next, a configuration of the plasma display device of the present embodiment is described. FIG. 3 is a circuit block diagram of plasma display device 1 of the exemplary embodiment of the present invention. Plasma display device 1 has the following elements:

panel 10;
image signal processing circuit 41;
data electrode driving circuit 42;
scan electrode driving circuit 43;
sustain electrode driving circuit 44;
timing generating circuit 45; and
a power supply circuit (not shown) for supplying power required for each circuit block.

Image signal processing circuit 41 converts input image signal sig into image data that indicates light emission or no light emission in each subfield in response to the number of pixels of panel 10.

Data electrode driving circuit 42 converts the image data in each subfield into a signal corresponding to each of data electrode D1 through data electrode Dm, and drives each of data electrode D1 through data electrode Dm based on a timing signal.

Timing generating circuit 45 generates various timing signals for controlling operations of respective circuit blocks based on horizontal synchronizing signal H and vertical synchronizing signal V. Timing generating circuit 45 supplies the timing signals to respective circuit blocks (image signal processing circuit 41, data electrode driving circuit 42, scan electrode driving circuit 43, and sustain electrode driving circuit 44).

Scan electrode driving circuit 43 has an initializing waveform generating circuit (not shown), a sustain pulse generating circuit (not shown), and a scan pulse generating circuit (not shown). The initializing waveform generating circuit generates an initializing waveform to be applied to scan electrode SC1 through scan electrode SCn in the initializing period. The sustain pulse generating circuit generates a sustain pulse to be applied to scan electrode SC1 through scan electrode SCn in the sustain period. The scan pulse generating circuit has a plurality of scan ICs, and generates a scan pulse to be applied to scan electrode SC1 through scan electrode SCn in the address period. Scan electrode driving circuit 43 drives each of scan electrode SC1 through scan electrode SCn based on the timing signal.

Sustain electrode driving circuit 44 has a sustain pulse generating circuit and a circuit (not shown) for generating voltage Ve1 and voltage Ve2, and drives sustain electrode SU1 through sustain electrode SUn based on the timing signal.

Figure 4:
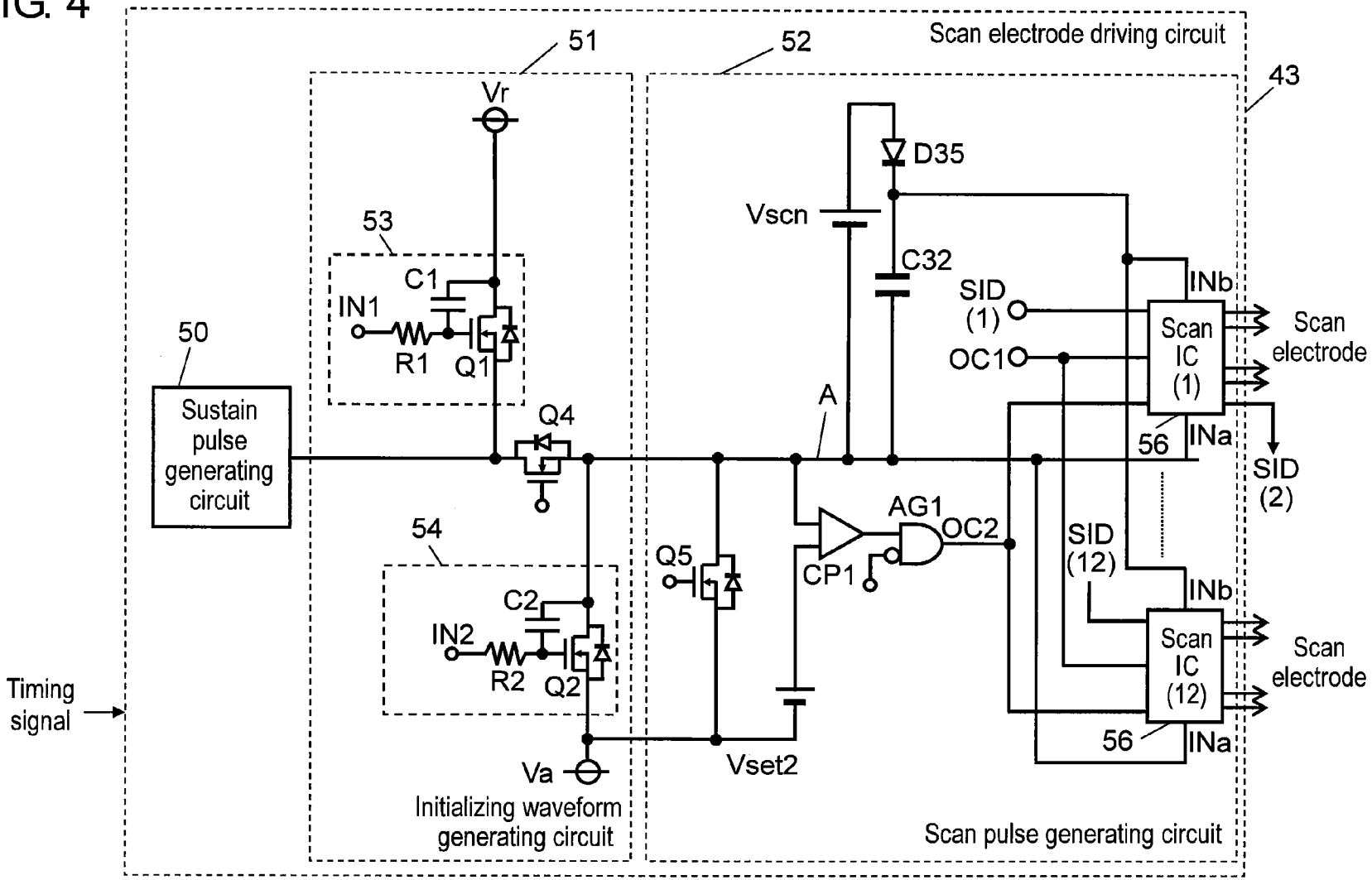
FIG. 4 is a circuit diagram of a scan electrode driving circuit in accordance with the exemplary embodiment.

Next, the detail of scan electrode driving circuit 43 is described. FIG. 4 is a circuit diagram of scan electrode driving circuit 43 in accordance with the exemplary embodiment of the present invention. Scan electrode driving circuit 43 has the following elements:

sustain pulse generating circuit 50 for generating a sustain pulse;
initializing waveform generating circuit 51 for generating an initializing waveform; and
scan pulse generating circuit 52 for generating a scan pulse.

Each output terminal of scan pulse generating circuit 52 is connected to each of scan electrode SC1 through scan electrode SCn of panel 10. In the following description, the operation of conducting a switching element is denoted with "ON", and the operation of breaking it is denoted with "OFF". A signal for setting the switching element at ON is denoted with "Hi", and a signal for setting it at OFF is denoted with "Lo".

Sustain pulse generating circuit 50 has a generally used electric power recovering circuit (not shown) and a clamping circuit (not shown), and switches each switching element disposed in it and generates a sustain pulse based on a timing signal output from timing generating circuit 45. Sustain pulse generating circuit 50 also has a Miller integrating circuit (not shown) for generating an increasing ramp voltage, and generates erasing ramp voltage described later at the end of the sustain period. In FIG. 4, the detail of the signal path of the timing signal is omitted.

Initializing waveform generating circuit 51 has Miller integrating circuit 53 and Miller integrating circuit 54. Miller integrating circuit 53 has switching element Q1, capacitor C1, and resistor R1, and increases reference potential A of scan pulse generating circuit 52 in a ramp shape. Miller integrating circuit 54 has switching element Q2, capacitor C2, and resistor R2, and decreases reference potential A of scan pulse generating circuit 52 in a ramp shape. Miller integrating circuit 53 generates increasing ramp voltage (up-ramp voltage described later) in the initializing operation, and Miller integrating circuit 54 generates decreasing ramp voltage (down-ramp voltage described later) in the initializing operation. FIG. 4 shows an input terminal of Miller integrating circuit 53 as input terminal IN1, and an input terminal of Miller integrating circuit 54 as input terminal IN2.

FIG. 4 shows a separating circuit employing switching element Q4. Switching element Q4, when a circuit (for example, Miller integrating circuit 54) using negative voltage Va is operated, electrically separates this circuit from sustain pulse generating circuit 50 and a circuit (for example, Miller integrating circuit 53) using voltage Vr.

In the present embodiment, as initializing waveform generating circuit 51, a Miller integrating circuit using a practical field effect transistor (FET) having a relatively simple configuration is employed. However, the present embodiment is not limited to this configuration. Initializing waveform generating circuit 51 may be any circuit as long as it can gently increase or decrease reference potential A. For example, instead of the Miller integrating circuit, a resistance-capacitance (RC) integrating circuit may be employed.

Scan pulse generating circuit 52 has the following elements:

a plurality of scan ICs 56 (scan IC (1) through scan IC (12) in the present embodiment) for outputting a scan pulse to each of scan electrode SC1 through scan electrode SCn;
switching element Q5 for connecting reference potential A to negative voltage Va in the address period;
diode D35 and capacitor C32 for applying voltage Vc, which is derived by overlaying voltage Vscn on voltage Va, to the higher voltage side of scan ICs 56;

comparator CP1 for comparing the magnitudes of input signals input to two input terminals with each other; and AND gate AG1 for logical multiplication operation of an input signal to be input to two input terminals.

Voltage (Va+Vset2) is applied to one input terminal of comparator CP1, and the other input terminal is connected to reference potential A. An output terminal of comparator CP1 is connected to one input terminal of AND gate AG1, and a signal obtained by inverting a signal for controlling switching element Q5 is input to the other input terminal of AND gate AG1.

Each of scan ICs 56 has two input terminals, namely input terminal INa existing on the lower voltage side and input terminal INb existing on the higher voltage side, and outputs one of the signals input to two input terminals based on control signals. Control signal OC1 output from timing generating circuit 45 and control signal OC2 output from AND gate AG1 are input as the control signals to each of scan ICs 56. Scan start signal SID (1) output from timing generating circuit 45 immediately after the start of the address period is input to scan IC (1) that performs address operation initially in the address period. A clock signal as a synchronizing signal for synchronizing signal processing operation is commonly input to all scan ICs 56 (scan IC (1) through scan IC (12) in the present embodiment), but the path is omitted in FIG. 4.

In the present embodiment, it is assumed that 90 switching elements for output are integrated as one monolithic IC and panel 10 has 1080 scan electrodes 22. Scan pulse generating circuit 52 is formed of 12 scan IC (1) through scan IC (12), and scan electrode SC1 through scan electrode SCn (n is 1080) are driven. Thus, by integrating many switching elements, the number of components can be reduced and the mounting area can be reduced. The numerical values shown in the present embodiment are one example, and the present invention is not limited to these numerical values.

The switching elements disposed in scan ICs 56 are switched in response to scan start signal SID, control signal OC1, and control signal OC2.

Scan pulse generating circuit 52 is controlled by timing generating circuit 45 so as to output a voltage waveform of initializing waveform generating circuit 51 in the initializing period and output a voltage waveform of sustain pulse generating circuit 50 in the sustain period.

Figure 5:
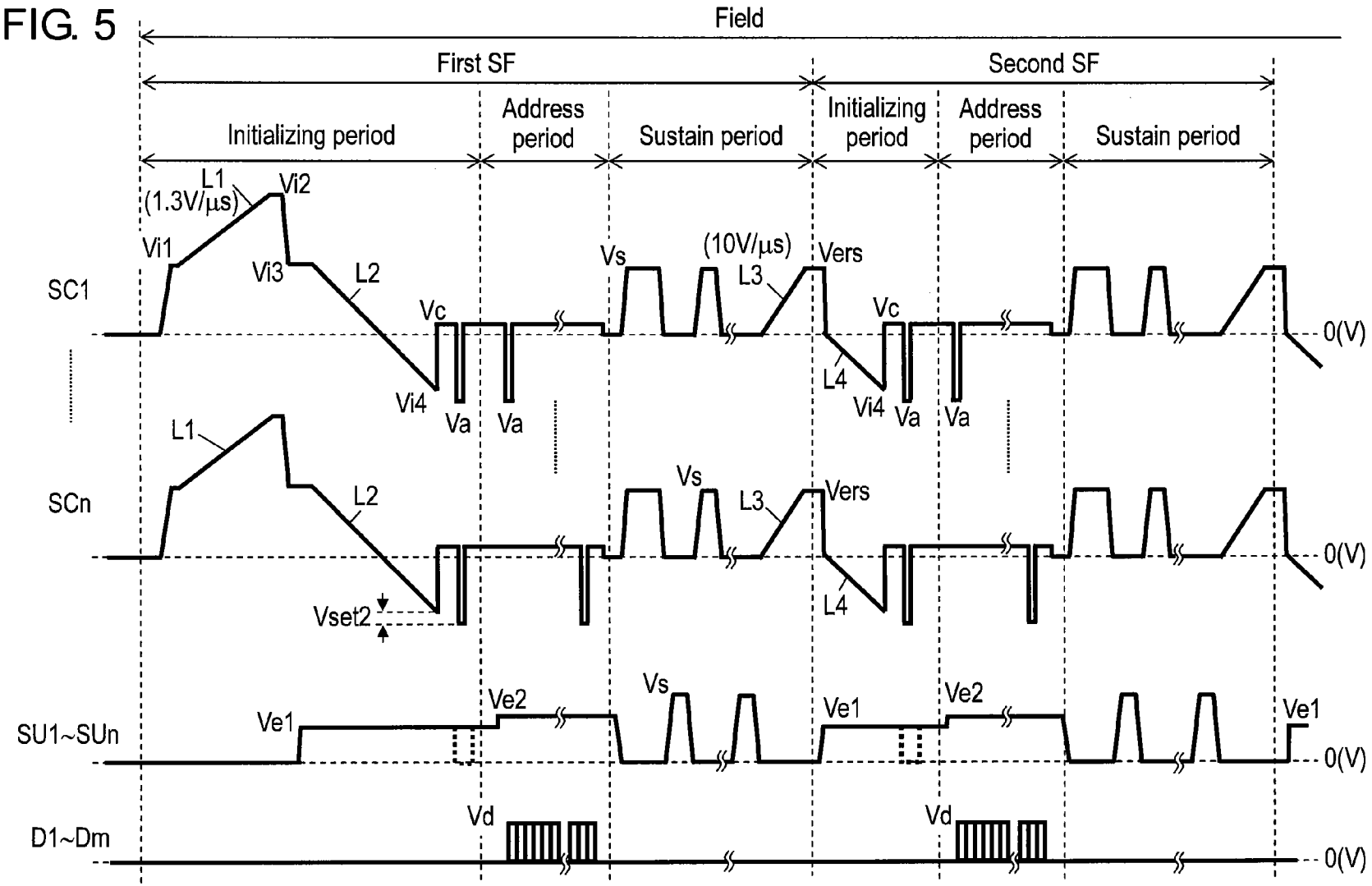
FIG. 5 is a waveform chart of driving voltage to be applied to each electrode of the panel in accordance with the exemplary embodiment.

Next, a driving voltage waveform and its operation for driving panel 10 are described schematically using FIG. 5. The plasma display device of the present embodiment performs gradation display by a subfield method. In other words, the plasma display device of the present embodiment divides one field into a plurality of subfields on the time axis, sets luminance weight for each subfield, and controls light emission and no light emission of each discharge cell in each subfield, thereby performing the gradation display. Each subfield has an initializing period for initializing each discharge cell, an address period for performing the address operation to each discharge cell in response to an image signal, and a sustain period for generating sustain discharge in the discharge cell having undergone the address.

In this subfield method, for example, one field is formed of 8 subfields (first SF, second SF, . . . , eighth SF), and respective subfields have luminance weights of 1, 2, 4, 8, 16, 32, 64, 128. In the sustain period of each subfield, as many sustain pulses as the number derived by multiplying the luminance weight of the subfield by a predetermined luminance magnification are applied to respective display electrode pairs 24.

In the initializing period of one subfield, of a plurality of subfields constituting one field, all-cell initializing operation of causing the initializing discharge in all discharge cells is performed. In the initializing period of the other subfield, selective initializing operation of selectively causing the initializing discharge in the discharge cell that has undergone sustain discharge in the immediately preceding subfield is performed. Thus, light emission related to no gradation display can be minimized and the contrast ratio can be increased.

In the present embodiment, all-cell initializing operation is performed in the initializing period of the first SF, and selective initializing operation is performed in the initializing period of the second SF through eighth SF. Thus, light emission related to no image display is only light emission following the discharge of the all-cell initializing operation in the first SF. The luminance of black level, which is luminance in a black display region that does not cause sustain discharge, is therefore determined only by weak light emission in the all-cell initializing operation. This allows image display of sharp contrast in plasma display device 1.

In the present invention, the number of subfields and luminance weight of each subfield are not limited to the above-mentioned values. The subfield structure is changed based on an image signal or the like.

FIG. 5 is a waveform chart of driving voltage applied to each electrode of panel 10 in accordance with the exemplary embodiment of the present invention.

FIG. 5 shows driving waveforms of scan electrode SC1 for performing address operation initially in the address period, scan electrode SCn (for example, scan electrode SC1080) for performing address operation finally in the address period, sustain electrode SU1 through sustain electrode SUn, and data electrode D1 through data electrode Dm.

FIG. 5 shows driving voltage waveforms of two subfields, namely a first subfield (first SF) and a second subfield (second SF). The first subfield is a subfield (hereinafter referred to as "all-cell initializing subfield") for performing all-cell initializing operation, and the second subfield is a subfield (hereinafter referred to as "selective initializing subfield") for performing selective initializing operation. However, the driving voltage waveforms in other subfields are substantially similar to the driving voltage waveform in the second SF except that the number of sustain pulses in the sustain period is changed. Scan electrode SCi, sustain electrode SUi, and data electrode Dk described later are selected based on image data from scan electrodes, sustain electrodes, and data electrodes, respectively.

First, a first SF as the all-cell initializing subfield is described.

In the first half of the initializing period of the first SF, 0 (V) is applied to data electrode D1 through data electrode Dm and sustain electrode SU1 through sustain electrode SUn, and two ramp voltages are sequentially applied to scan electrode SC1 through scan electrode SCn. Here, the first ramp voltage increases from 0 (V) to voltage Vi1, which is not higher than a discharge start voltage with respect to sustain electrode SU1 through sustain electrode SUn. The second ramp voltage is ramp voltage (hereinafter referred to as "up-ramp voltage") L1 further gradually increasing from voltage Vi1 to voltage Vi2, which is higher than the discharge start voltage.

While up-ramp voltage L1 increases, feeble initializing discharge continuously occurs between scan electrode SC1 through scan electrode SCn and sustain electrode SU1 through sustain electrode SUn, and feeble initializing discharge continuously occurs between scan electrode SC1 through scan electrode SCn and data electrode D1 through data electrode Dm. Negative wall voltage is accumulated on scan electrode SC1 through scan electrode SCn, and positive wall voltage is accumulated on data electrode D1 through data electrode Dm and sustain electrode SU1 through sustain electrode SUn.

In the latter half of the initializing period, positive voltage Ve1 is applied to sustain electrode SU1 through sustain electrode SUn, and 0 (V) is applied to data electrode D1 through data electrode Dm. Ramp voltage (hereinafter referred to as "down-ramp voltage") L2 is applied to scan electrode SC1 through scan electrode SCn. Here, down-ramp voltage L2 gradually decreases from voltage Vi3, which is not higher than the discharge start voltage, to voltage Vi4, which is higher than the discharge start voltage, with respect to sustain electrode SU1 through sustain electrode SUn.

While down-ramp voltage L2 decreases, feeble initializing discharge occurs between scan electrode SC1 through scan electrode SCn and sustain electrode SU1 through sustain electrode SUn, and feeble initializing discharge occurs between scan electrode SC1 through scan electrode SCn and data electrode D1 through data electrode Dm. The negative wall voltage on scan electrode SC1 through scan electrode SCn, the positive wall voltage on sustain electrode SU1 through sustain electrode SUn, and positive wall voltage on data electrode D1 through data electrode Dm are reduced.

In the present embodiment, after down-ramp voltage L2 is generated, negative pulse voltage (hereinafter referred to as "adjusting pulse") lower than the minimum voltage of down-ramp voltage L2 is generated at a pulse width causing no discharge, and is applied to scan electrode SC1 through scan electrode SCn. This pulse width represents time interval since the decrease of the voltage until the increase thereof. Thus, applying the adjusting pulse to scan electrode SC1 through scan electrode SCn further reduces the negative wall voltage on scan electrode SC1 through scan electrode SCn and the positive wall voltage on data electrode D1 through data electrode Dm, thereby adjusting the wall voltage in the discharge cell to a value appropriate for address operation.

In the present embodiment, the adjusting pulse is generated at voltage Va equal to scan pulse voltage. The difference between voltage Va and minimum voltage Vi4 of down-ramp voltage L2 is hereinafter referred to as "Vset2"

The all-cell initializing operation of performing initializing discharge in all discharge cells is completed.

In the subsequent address period, scan pulse voltage is sequentially applied to scan electrode SC1 through scan electrode SCn, and positive address pulse voltage Vd is applied to data electrode Dk (k is 1 through m) corresponding to the discharge cell to emit light, of data electrode D1 through data electrode Dm, thereby selectively causing address discharge in each discharge cell.

In the address period, voltage Ve2 is firstly applied to sustain electrode SU1 through sustain electrode SUn, and voltage Vc (Vc=Va+Vscn) is applied to scan electrode SC1 through scan electrode SCn.

Then, negative scan pulse voltage Va is applied to scan electrode SC1 in the first row, positive address pulse voltage Vd is applied to data electrode Dk (k is 1 through m) in the discharge cell to emit light in the first row, of data electrode D1 through data electrode Dm. At this time, the voltage difference in the intersecting part of data electrode Dk and scan electrode SC1 is derived by adding the difference between the wall voltage on data electrode Dk and that on scan electrode SC1 to the difference (Vd−Va) of the external applied voltage, and exceeds the discharge start voltage. Discharge thus occurs between data electrode Dk and scan electrode SC1. Since voltage Ve2 is applied to sustain electrode SU1 through sustain electrode SUn, the voltage difference between sustain electrode SU1 and scan electrode SC1 is derived by adding the difference between the wall voltage on sustain electrode SU1 and that on scan electrode SC1 to the difference (Ve2−Va) of the external applied voltage. At this time, by setting voltage Ve2 at a voltage value slightly lower than the discharge start voltage, a state where discharge does not occur but is apt to occur can be caused between sustain electrode SU1 and scan electrode SC1. Therefore, the discharge occurring between data electrode Dk and scan electrode SC1 can cause discharge between sustain electrode SU1 and scan electrode SC1 that exist in a region crossing data electrode Dk. Thus, address discharge occurs in the discharge cell to emit light, positive wall voltage is accumulated on scan electrode SC1, negative wall voltage is accumulated on sustain electrode SU1, and negative wall voltage is also accumulated on data electrode Dk.

Thus, address operation of causing address discharge in the discharge cell to emit light in the first row and accumulating wall voltage on each electrode is performed. The voltage in the parts where scan electrode SC1 intersects with data electrode D1 through data electrode Dm to which address pulse voltage Vd is not applied does not exceed the discharge start voltage, so that address discharge does not occur. This address operation is sequentially repeated until it reaches the discharge cell in the n-th row, and the address period is completed.

In the address period, when excessive wall voltage is accumulated in the initializing period, strong address discharge occurs, and much wall voltage is lost and a discharge failure can occur in the address operation in a discharge cell adjacent to the discharge cell that has undergone the strong address discharge.

When the wall voltage to be accumulated in the initializing period is insufficient, address discharge itself does not occur and an unlit cell occurs.

In the present embodiment, as discussed above, down-ramp voltage L2 is generated, then the adjusting pulse is generated and applied to scan electrode SC1 through scan electrode SCn, and negative wall voltage on scan electrode SC1 through scan electrode SCn and positive wall voltage on data electrode D1 through data electrode Dm are adjusted into a state where address discharge can be stably caused. Thus, occurrence of an abnormal discharge and an unlit cell is suppressed, and stable address operation can be performed.

In the subsequent sustain period, as many sustain pulses as the number derived by multiplying the luminance weight by a predetermined luminance magnification are alternately applied to display electrode pairs 24, sustain discharge is caused to emit light in the discharge cell having undergone the address discharge.

In the sustain period, positive sustain pulse voltage Vs is firstly applied to scan electrode SC1 through scan electrode SCn, and the ground potential as a base potential, namely 0 (V), is applied to sustain electrode SU1 through sustain electrode SUn. In the discharge cell having undergone the address discharge, the voltage difference between scan electrode SCi and sustain electrode SUi is obtained by adding the difference between the wall voltage on scan electrode SCi and that on sustain electrode SUi to sustain pulse voltage Vs, and exceeds the discharge start voltage.

Thus, sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell where address discharge has not occurred in the address period, sustain discharge does not occur and the wall voltage at the end of the initializing period is kept.

Subsequently, 0 (V) as the base potential is applied to scan electrode SC1 through scan electrode SCn, and sustain pulse voltage Vs is applied to sustain electrode SU1 through sustain electrode SUn. In the discharge cell having undergone the sustain discharge, the voltage difference between sustain electrode SUi and scan electrode SCi exceeds the discharge start voltage, so that sustain discharge occurs between sustain electrode SUi and scan electrode SCi again. Therefore, negative wall voltage is accumulated on sustain electrode SUi, and positive wall voltage is accumulated on scan electrode SCi. Hereinafter, similarly, as many sustain pulses as the number derived by multiplying the luminance weight by luminance magnification are alternately applied to scan electrode SC1 through scan electrode SCn and sustain electrode SU1 through sustain electrode SUn to cause potential difference between the electrodes of display electrode pairs 24. Thus, sustain discharge is continuously performed in the discharge cell where the address discharge has been caused in the address period.

At the end of the sustain period, sustain electrode SU1 through sustain electrode SUn are returned to 0 (V), then second ramp voltage (hereinafter referred to as "erasing ramp voltage") L3 is applied to scan electrode SC1 through scan electrode SCn. Here, erasing ramp voltage L3 increases from 0 (V) as the base potential to voltage Vers, which is higher than the discharge start voltage. Thus, feeble discharge (hereinafter referred to as "erasing discharge") is caused between sustain electrode SUi and scan electrode SCi of the discharge cell having undergone the sustain discharge. Charged particles generated by the erasing discharge are accumulated on sustain electrode SUi and scan electrode SCi to produce wall charge so as to reduce the voltage difference between sustain electrode SUi and scan electrode SCi. Thus, while positive wall charge is left on data electrode Dk, the wall voltage on scan electrode SCi and sustain electrode SUi is decreased to the extent of the difference between the voltage applied to scan electrode SCi and the discharge start voltage, namely (voltage Vers-discharge start voltage).

Then, scan electrode SC1 through scan electrode SCn are returned to 0 (V), and the sustain operation in the sustain period is completed.

In the initializing period of the second SF, a driving voltage waveform similar to that of the first SF, in which the first half part of the initializing period is omitted, is applied to each electrode. In other words, voltage Ve1 is applied to sustain electrode SU1 through sustain electrode SUn, 0 (V) is applied to data electrode D1 through data electrode Dm, and down ramp voltage L4 is applied to scan electrode SC1 through scan electrode SCn. Here, down-ramp voltage L4 gradually decreases from voltage (for example, 0 (V)), which is not higher than the discharge start voltage, to negative voltage Vi4.

Thus, in the discharge cell having undergone sustain discharge in the sustain period of the immediately preceding subfield (first SF in FIG. 5), feeble initializing discharge occurs, and the negative wall voltage on scan electrode SCi, the positive wall voltage on sustain electrode SUi, and positive wall voltage on data electrode Dk (k is 1 through m) are reduced. While, in the discharge cell having undergone no sustain discharge in the immediately preceding subfield, discharge does not occur, and the state of the wall charge at the completion of the initializing period of the preceding subfield is kept as it is. Thus, the initializing operation of the second SF is selective initializing operation of performing initializing discharge in the discharge cell that has undergone sustain operation in the sustain period of the immediately preceding subfield.

In the present embodiment, down-ramp voltage L4 is generated, then an adjusting pulse is generated and is applied to scan electrode SC1 through scan electrode SCn. Thus, the negative wall voltage on scan electrode SC1 through scan electrode SCn and the positive wall voltage on data electrode D1 through data electrode Dm are further reduced, thereby adjusting the wall voltage in the discharge cell to a value appropriate for address operation.

In the address period of the second SF, a driving waveform similar to that in the address period of the first SF is applied to scan electrode SC1 through scan electrode SCn, sustain electrode SU1 through sustain electrode SUn, and data electrode D1 through data electrode Dm.

Also in the address period of the second SF, similarly to the address period of the first SF, an adjusting pulse generated after down-ramp voltage L4 can suppress the occurrence of an abnormal discharge and an unlit cell, and stable address operation can be performed.

In the sustain period of the second SF, similarly to the sustain period of the first SF, a predetermined number of sustain pulses are alternately applied to scan electrode SC1 through scan electrode SCn and sustain electrode SU1 through sustain electrode SUn. Thus, sustain discharge is caused in the discharge cell having undergone address discharge in the address period.

In the third SF or later, driving waveforms similar to those in the second SF are applied to scan electrode SC1 through scan electrode SCn, sustain electrode SU1 through sustain electrode SUn, and data electrode D1 through data electrode Dm except that the number of sustain pulses in the sustain period is changed.

The outline of the driving voltage waveform applied to each electrode of panel 10 has been described.

The adjusting pulse of the present embodiment is used for adjusting the negative wall voltage on scan electrode SC1 through scan electrode SCn and positive wall voltage on data electrode D1 through data electrode Dm that are formed by the initializing discharge. Therefore, as shown by broken lines in FIG. 5, 0 (V) may be applied to sustain electrode SU1 through sustain electrode SUn while the adjusting pulse is applied to scan electrode SC1 through scan electrode SCn.

Figure 6:
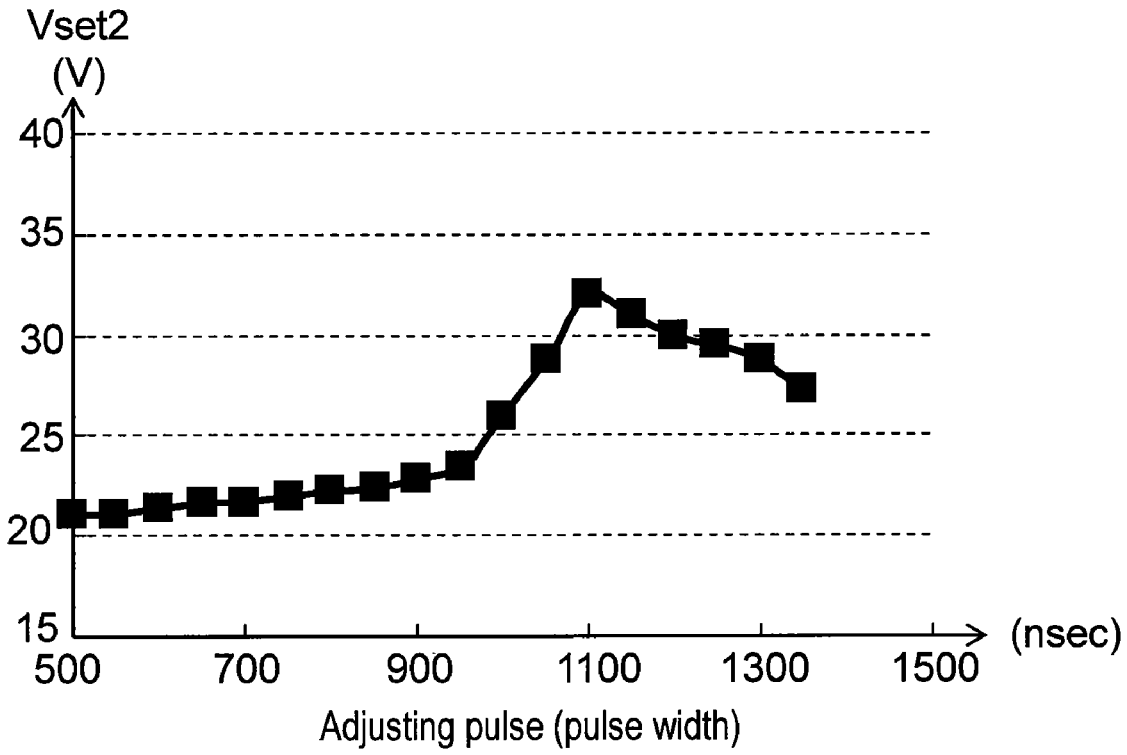
FIG. 6 is a characteristic diagram showing the relation between the pulse width of an adjusting pulse and voltage Vset2 in accordance with the exemplary embodiment.

Next, a pulse waveform of an adjusting pulse is described. FIG. 6 is a characteristic diagram showing the relation between the pulse width of the adjusting pulse and voltage Vset2 in accordance with the exemplary embodiment of the present invention. In FIG. 6, the horizontal axis shows the pulse width of the adjusting pulse, and the vertical axis shows voltage Vset2 (difference between voltage Vi4 and voltage Va) allowing stable address discharge. When this characteristic is measured, voltage Vi4 is fixed, and voltage Vset2 is changed by changing voltage Va. As discussed above, the adjusting pulse and scan pulse are generated at the same negative voltage Va.

As discussed above, in the address operation, address discharge is caused by applying, to the discharge cell, difference between positive address pulse voltage Vd applied to data electrode Dk (k is 1 through m) and negative scan pulse voltage Va. Therefore, when voltage Vset2 is increased, namely when negative voltage Va is decreased (the absolute value thereof is increased), the voltage value of positive address pulse voltage Vd can be decreased. The scan pulse is a driving voltage to be sequentially applied to scan electrode SC1 through scan electrode SCn, and the address pulse is a driving voltage to be applied to data electrode Dk (k is 1 through m) in response to a display image, so that the number of generated address pulses is relatively large. Therefore, when the voltage value of positive address pulse voltage Vd can be decreased, the power consumption can be reduced. In the present embodiment, the pulse width of the adjusting pulse is set so that voltage Vset2 can be set at 25 (V) or higher, for example.

As shown in FIG. 6, when the pulse width is in a range of 1100 nsec or narrower, increasing the pulse width of the adjusting pulse gradually increases voltage Vset2 allowing stable address discharge. This is considered to be because increasing the pulse width of the adjusting pulse gradually increases the adjusting effect of the wall charge.

While, when the pulse width is in a range of 1100 nsec or wider, increasing the pulse width of the adjusting pulse gradually decreases voltage Vset2 allowing stable address discharge. This is considered to be because the pulse width of the adjusting pulse approaches "discharge delay" and the occurrence probability of discharge increases.

This "discharge delay" means time delay since the voltage applied to the discharge cell exceeds the discharge start voltage until discharge actually occurs. Even when the voltage applied to the discharge cell exceeds the discharge start voltage, discharge does not occur if the voltage applied to the discharge cell is returned to a voltage of the discharge start voltage or lower before occurrence of discharge. The adjusting pulse of the present embodiment is not used for causing discharge, but is used for adjusting the wall charge by varying the potential of scan electrode SC1 through scan electrode SCn after occurrence of the initializing discharge. When the adjusting pulse causes discharge in the discharge cell, the discharge significantly reduces the wall voltage and hence generates an unlit cell (namely, a discharge cell where address discharge does not occur and light is not emitted although address discharge is required to occur). Therefore, the pulse width of the adjusting pulse needs to be set in a range where discharge does not occur.

The characteristic diagram of FIG. 6 thus concludes that it is preferable to set the pulse width of the adjusting pulse at 1000 to 1250 nsec. These numerical values are one example of the present invention, and the present invention is limited to these values. The pulse width of the adjusting pulse and voltage Vset2 are required to be set appropriately in response to the characteristic of the panel or the specification of the plasma display device.

Next, the operation and initializing waveform of scan electrode driving circuit 43 and occurrence of an adjusting pulse are described with reference to FIG. 7.

Figure 7:
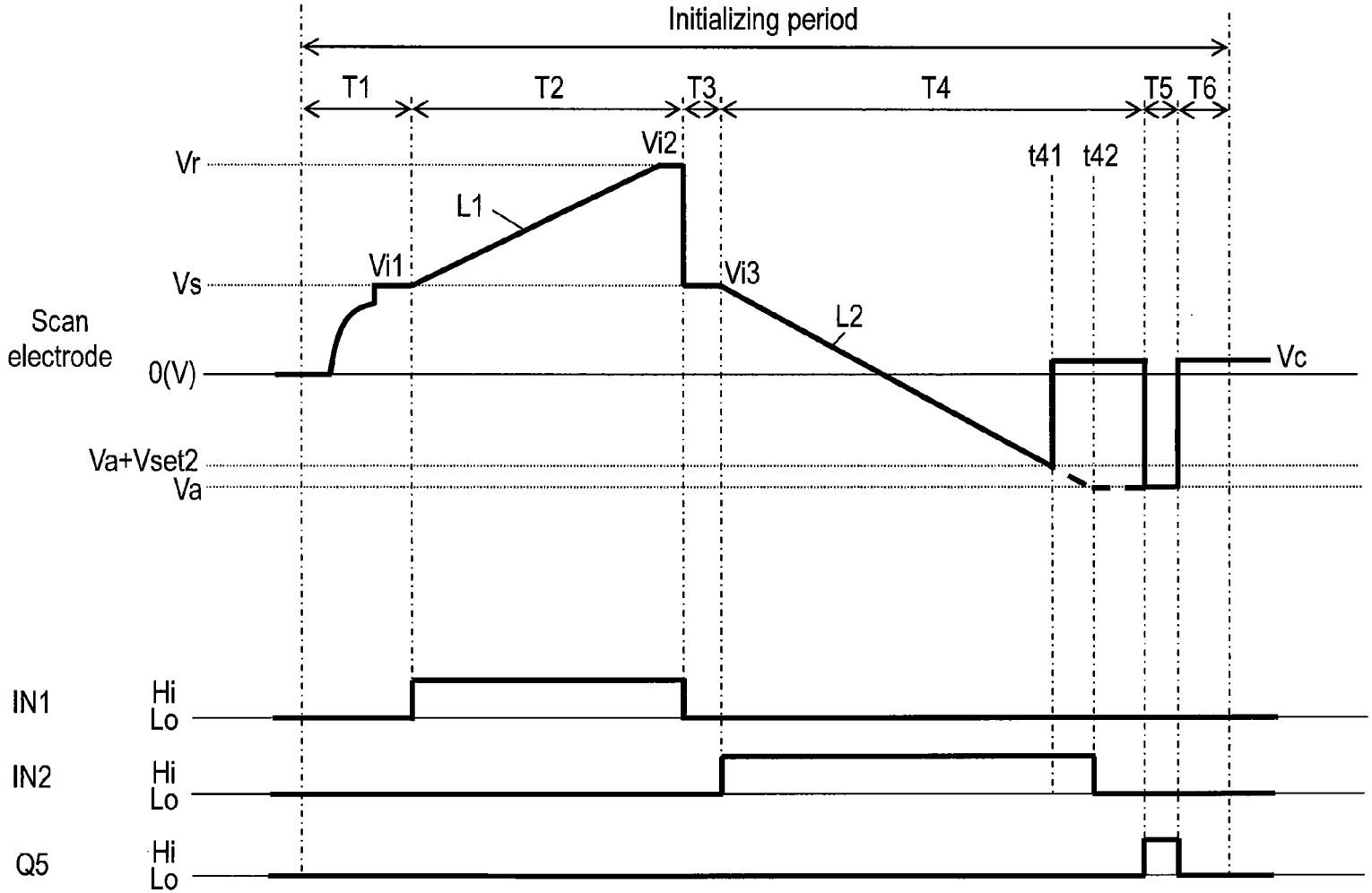
FIG. 7 is a timing chart for illustrating one example of the operation of the scan electrode driving circuit in an all-cell initializing period in accordance with the exemplary embodiment.

FIG. 7 is a timing chart for illustrating one example of the operation of scan electrode driving circuit 43 in the all-cell initializing period in accordance with the exemplary embodiment of the present invention. In FIG. 7, each driving voltage waveform used in the all-cell initializing operation is divided into six time periods represented by time period T1 through time period T6, and each time period is described.

In FIG. 7, it is assumed that voltage Vi1 and voltage Vi3 are equal to voltage Vs, and voltage Vi2 is equal to voltage Vr.

In the following description, the operation of conducting a switching element is denoted with "ON", and the operation of breaking it is denoted with "OFF". In FIG. 7, a signal for setting the switching element at ON is denoted with "Hi", and a signal for setting it at OFF is denoted with "Lo".

(Time Period T1)

First, an electric power recovering circuit of sustain pulse generating circuit 50 is operated, and the voltage of scan electrode SC1 through scan electrode SCn is increased. Then, a damping circuit of sustain pulse generating circuit 50 is operated, and the potential of scan electrode SC1 through scan electrode SCn is set at voltage Vs (equal to voltage Vi1 in the present embodiment).

(Time Period T2)

Next, input terminal IN1 of Miller integrating circuit 53 for generating up-ramp voltage is set at "Hi". Specifically, a predetermined constant current is input to input terminal IN1. Constant current then flows from resistor R1 toward capacitor C1, the source voltage of switching element Q1 increases in a ramp shape, and the output voltage of scan electrode driving circuit 43 also starts to increase in a ramp shape. This voltage increase continues while input terminal IN1 is at "Hi".

When the output voltage increases to voltage Vr (equal to voltage Vi2 in the present embodiment), input terminal IN1 is set at "Lo". Specifically, 0 (V) is applied to input terminal IN1, for example.

Thus, up-ramp voltage L1 is generated and applied to scan electrode SC1 through scan electrode SCn. Here, up-ramp voltage L1 gradually increases from voltage Vs (equal to voltage Vi1 in the present embodiment), which is not higher than the discharge start voltage, to voltage Vr (equal to voltage Vi2 in the present embodiment), which is higher than the discharge start voltage.

All-cell initializing operation of causing initializing discharge in all discharge cells is thus allowed.

(Time Period T3)

When input terminal IN1 is set at "Lo", the voltage of scan electrode SC1 through scan electrode SCn decreases to voltage Vs (equal to voltage Vi3 in the present embodiment).

(Time Period T4)

Next, input terminal IN2 of Miller integrating circuit 54 for generating a down-ramp voltage is set at "Hi". Specifically, a predetermined constant current is input to input terminal IN2. Constant current then flows from resistor R2 toward capacitor C2, the drain voltage of switching element Q2 decreases in a ramp shape, and the output voltage of scan electrode driving circuit 43 also starts to decrease in a ramp shape.

Comparator CP1 compares reference potential A, namely a down-ramp voltage output from initializing waveform generating circuit 51, with voltage (Va+Vset2) derived by adding voltage Vset2 to voltage Va. The comparison result is input to AND gate AG1. At this time, switching element Q5 is in OFF state. In other words, the control signal of switching element Q5 is in "Lo" state (not shown), so that "Hi" obtained by inverting "Lo" is input to one input terminal of AND gate AG1. Therefore, the output signal from comparator CP1 is output as control signal OC2 from AND gate AG1 without change. Thus, the output signal from comparator CP1, namely control signal OC2, is switched from "Lo" to "Hi" at time t41 when the down-ramp voltage at reference potential A is voltage (Va+Vset2) or lower (not shown).

At time t41, therefore, both control signal OC1 and control signal OC2 come into the "Hi" state. Thus, the voltage output from scan IC 56 is switched from the voltage input to input terminal INa to the voltage input to input terminal INb. In other words, the voltage output from scan IC 56 is switched from the voltage output from initializing waveform generating circuit 51 to the voltage derived by overlaying voltage Vscn on reference potential A. Thus, the voltage output from scan IC 56 is switched from voltage decrease to voltage increase at time t41. Thus, the minimum voltage of down-ramp voltage L2 applied to scan electrode SC1 through scan electrode SCn becomes voltage (Va+Vset2).

At time t42 when the drain voltage of switching element Q2 becomes substantially equal to negative voltage Va to stop the voltage decrease, 0 (V), for example, is applied to input terminal IN2 to put input terminal IN2 into the "Lo" state. At this time, the voltage of reference potential A is kept at a voltage substantially equal to negative voltage Va. Since both control signal OC1 and control signal OC2 are kept in the "Hi" state, however, the voltage input to input terminal INa, namely the voltage (voltage Vc) derived by overlaying voltage Vscn on reference potential A, is output from scan IC 56.

(Time Period T5)

Next, "Hi" is applied to switching element Q5 to set switching element Q5 at ON. Thus, reference potential A is clamped on negative voltage Va. Additionally, "Lo" obtained by inverting "Hi" that is applied to switching element Q5 is input to one input terminal of AND gate AG1. Therefore, control signal OC2 output from AND gate AG1 is switched from "Hi" to "Lo" (not shown), and the voltage input to input terminal INa, namely negative voltage Va, is output from scan IC 56.

After a predetermined period (about 1000 nsec in the present embodiment), "Hi" is applied to switching element Q5 to set switching element Q5 at ON. Thus, control signal OC2 output from AND gate AG1 is switched from "Lo" to "Hi" (not shown), and the voltage input to input terminal INb, namely voltage Vc, is output from scan IC 56.

Thus, an adjusting pulse with a predetermined pulse width (about 1000 nsec) is applied to scan electrode SC1 through scan electrode SCn.

(Time Period T6)

While the voltage applied to scan electrode SC1 through scan electrode SCn is kept at voltage Vc, the subsequent address period is prepared for.

In this process, in the initializing period for performing the all-cell initializing operation, scan electrode driving circuit 43 can firstly apply a ramp voltage increasing from 0 (V), which is not higher than the discharge start voltage, to voltage Vi1, which is not higher than the discharge start voltage, with respect to sustain electrode SU1 through sustain electrode SUn. Further, scan electrode driving circuit 43 can generate up-ramp voltage L1, then generate down-ramp voltage L2, and apply them to scan electrode SC1 through scan electrode SCn. Here, up-ramp voltage L1 gradually increases from voltage Vi1 to voltage Vi2, which is higher than the discharge start voltage, and down-ramp voltage L2 gradually decreases from voltage Vi3 to voltage (Va+Vset2). The adjusting pulse having a negative pulse voltage lower than minimum voltage Vi4 of down-ramp voltage L2 can be generated at a predetermined pulse width that causes no discharge in the discharge cell, and can be applied to scan electrode SC1 through scan electrode SCn. The operation of generating down-ramp voltage L4 and the operation of generating the adjusting pulse in the initializing period when the selective initializing operation is performed are substantially similar to those in time period T4, time period T5, and time period T6, and hence are not described.

As discussed above, in the initializing period of the present embodiment, after the generation of the down-ramp voltage, an adjusting pulse having a negative pulse voltage lower than minimum voltage Vi4 of the down-ramp voltage is generated, and is applied to scan electrode SC1 through scan electrode SCn. The wall voltage in the discharge cell can be adjusted into a state where the subsequent address discharge can be caused stably. Therefore, even in a high-definition panel, occurrence of an abnormal discharge and an unlit cell is suppressed in the address period, stable address operation can be performed, and the image display quality of the plasma display device can be improved.

Figure 8:
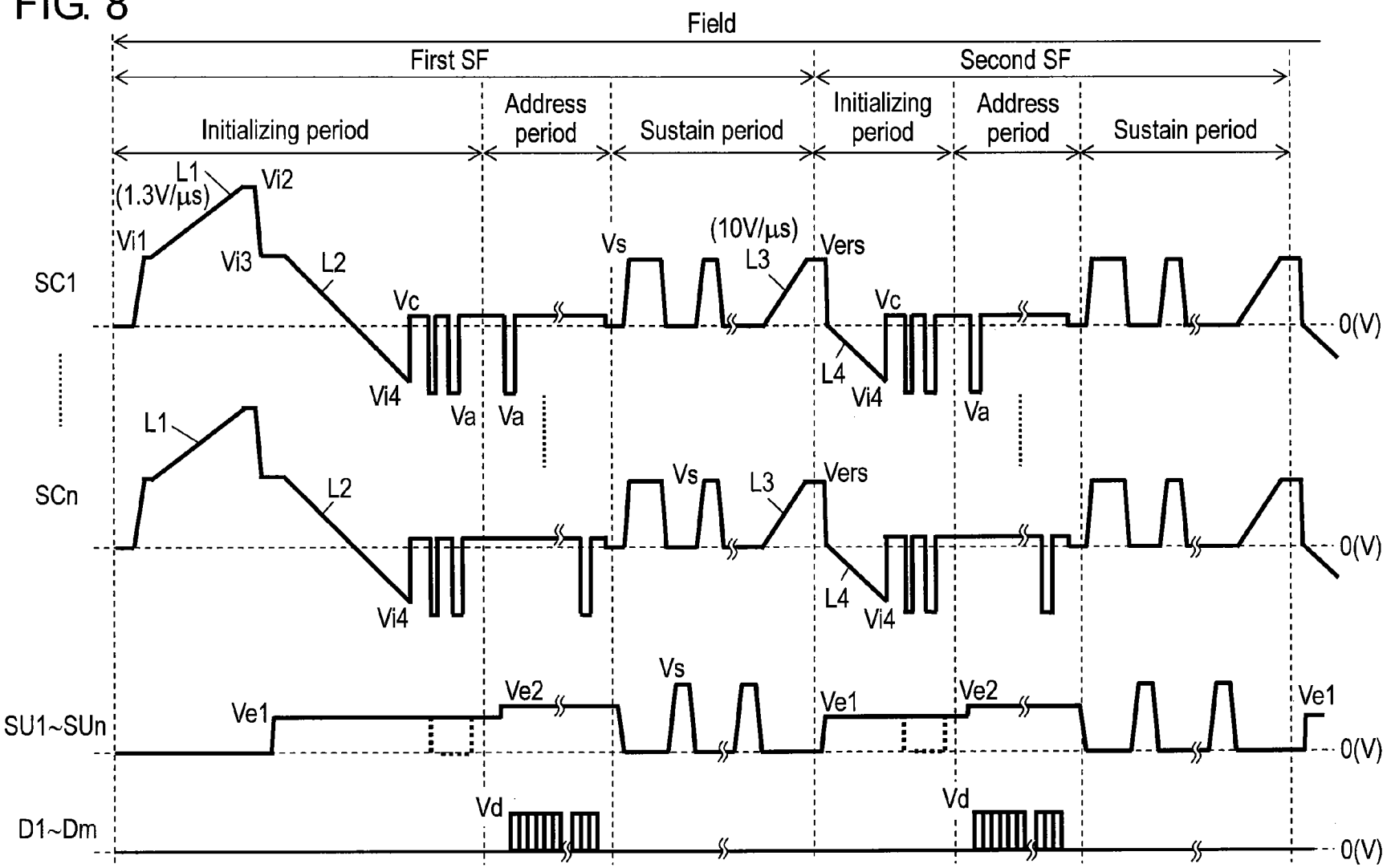
FIG. 8 is a waveform chart showing another example of the waveform of the driving voltage to be applied to each electrode of the panel in accordance with the exemplary embodiment.

In the present embodiment, one adjusting pulse is generated after generation of down-ramp voltage. However, a plurality of adjusting pulses may be generated continuously. FIG. 8 is a waveform chart showing another example of the waveform of the driving voltage to be applied to each electrode of panel 10 in accordance with the exemplary embodiment. For example, as shown in FIG. 8, it is recognized that the adjusting effect of wall voltage is further improved by continuously generating a plurality of adjusting pulses (two in the example of FIG. 8) after the generation of down-ramp voltage. It is also recognized to be preferable that the pulse width of each adjusting pulse is set so that the pulse width of a further preceding adjusting pulse is narrower, namely the pulse width of each adjusting pulse is set so that the pulse width sequentially becomes wider. This is because, when a plurality of adjusting pulses are generated continuously, the adjusting effect of the wall voltage is improved but the possibility of causing discharge by the adjusting pulses is increased. According to the experiment, by setting the pulse width of a preceding adjusting pulse at 850 nsec, of two continuously generated adjusting pulses, and by setting the pulse width of its next adjusting pulse at 1000 nsec, occurrence of an abnormal discharge and an unlit cell is further suppressed in the address period, and stabler address operation can be performed. However, the present invention is not limited to these numerical values. The number of adjusting pulses to be generated and the pulse widths of the adjusting pulses are preferably set appropriately in response to the characteristic of the panel or the specification of the plasma display device.

Figure 9:
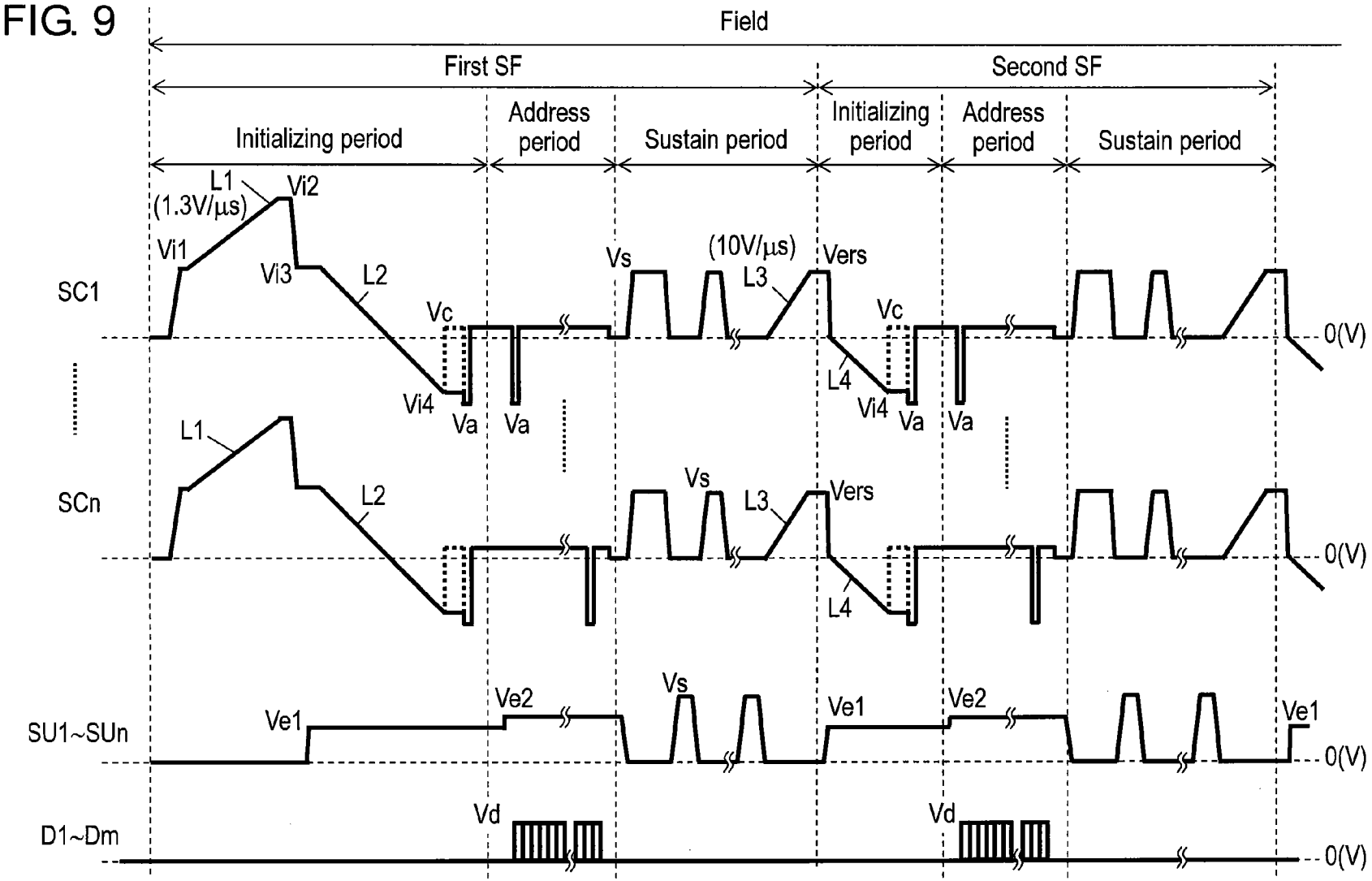
FIG. 9 is a waveform chart showing yet another example of the waveform of the driving voltage to be applied to each electrode of the panel in accordance with the exemplary embodiment.

In the present embodiment, a waveform where down-ramp voltage reaches the minimum voltage and then immediately increases is described. However, this waveform is employed simply dependently on the circuitry of scan electrode driving circuit 43. The present embodiment is not limited to this waveform. FIG. 9 is a waveform chart showing yet another example of the waveform of the driving voltage to be applied to each electrode of panel 10 in accordance with the exemplary embodiment of the present invention. For example, the waveform shown in FIG. 9 may be used. In other words, after the down-ramp voltage reaches the minimum voltage, the minimum voltage is kept, and then an adjusting pulse is generated. It is recognized that this waveform allows an effect similar to the above-mentioned effect.

It is recognized that influence of the time interval since the generation of the down-ramp voltage until the generation of the adjusting pulse on the above-mentioned effect is relatively small. However, in consideration of the time or the like taken for driving, it is practically preferable to generate the adjusting pulse within 10 μsec after the generation of the down-ramp voltage.

The timing chart shown in FIG. 7 is simply one example in the present embodiment, but the present invention is not limited to the timing chart.

The present embodiment of the present invention is effective also in a panel of an electrode structure where a scan electrode is adjacent to another scan electrode and a sustain electrode is adjacent to another sustain electrode, namely an electrode structure where the arrangement of the electrodes disposed on front plate 21 is "- - - scan electrode, scan electrode, sustain electrode, sustain electrode, scan electrode, scan electrode, - - - " (hereinafter referred to as "ABBA electrode structure").

Each specific numerical value shown in the present embodiment is set based on the characteristic of a 50-inch panel having 1080 display electrode pairs, and is simply one example in the present embodiment. The present invention is not limited to these numerical values. Numerical values to be employed are preferably set appropriately in response to the characteristic of the panel or the specification of the plasma display device. These numerical values can vary in a range allowing the above-mentioned effect. The polarity of each control signal shown when the operation of scan IC 56 is described is simply one example, and may be polarity reverse to the polarity used in the description.

Erasing ramp voltage is applied to scan electrode SC1 through scan electrode SCn in the present embodiment; however, erasing ramp voltage may be applied to sustain electrode SU1 through sustain electrode SUn. Alternatively, erasing ramp voltage is not employed, but erasing discharge may be caused by the so-called narrow width erasing pulse.

INDUSTRIAL APPLICABILITY

The present invention allows appropriate adjustment of wall charge in the initializing period. Therefore, even in a high-definition panel, occurrence of an abnormal discharge and an unlit cell is suppressed in the address period, stable address operation can be performed, and hence the image display quality can be improved. Therefore, the present invention is useful as a plasma display device and a driving method for the panel.

The invention claimed is:

1. A plasma display device comprising:

a plasma display panel that is driven by a subfield method and has a plurality of discharge cells, each of the discharge cells having a display electrode pair that includes a scan electrode and a sustain electrode, wherein the subfield method has a plurality of subfields in one field, and each of the subfields has an initializing period, an address period, and a sustain period;

a sustain electrode driving circuit for driving the sustain electrodes; and a scan electrode driving circuit for generating a decreasing down-ramp voltage in the initializing period, and generating a negative scan pulse voltage and applying the negative scan pulse voltage to the scan electrodes in the address period, wherein, in the initializing period, the sustain electrode driving circuit applies a positive voltage to the sustain electrodes while the scan electrode driving circuit applies the down-ramp voltage to the scan electrodes, and after the generation of the down-ramp voltage, the scan electrode driving circuit generates a negative pulse voltage lower than a minimum voltage of the down-ramp voltage and applies the negative pulse voltage to the scan electrodes, wherein the scan electrode driving circuit, after the generation of the down-ramp voltage, generates the plurality of negative pulse voltages whose pulse widths sequentially increase, and applies the negative pulse voltages to the scan electrodes.

2. A driving method for a plasma display panel, the plasma display panel having a plurality of discharge cells, each of the discharge cells having a display electrode pair that includes a scan electrode and a sustain electrode, the driving method comprising:

forming a plurality of subfields in one field, each of the subfields having an initializing period, an address period, and a sustain period;

generating a decreasing down-ramp voltage in the initializing period; and generating a negative scan pulse voltage and applying the negative scan pulse voltage to the scan electrodes in the address period, wherein, in the initializing period, a positive voltage is applied to the sustain electrodes while the down-ramp voltage being applied to the scan electrodes, and after the generation of the down-ramp voltage, a negative pulse voltage lower than a minimum voltage of the down-ramp voltage is generated and applied to the scan electrodes, wherein after the generation of the down-ramp voltage, the plurality of negative pulse voltages whose pulse widths sequentially increase are generated, and the negative pulse voltages are applied to the scan electrodes.

* * * * *

UNITED STATES PATENT AND TRADEMARK OFFICE

CERTIFICATE OF CORRECTION

PATENT NO. : 8,355,017 B2
APPLICATION NO. : 12/812151
DATED : January 15, 2013
INVENTOR(S) : Naoyuki Tomioka et al.

It is certified that error appears in the above-identified patent and that said Letters Patent is hereby corrected as shown below:

On Title Page 2, Item (56):

at FOREIGN PATENT DOCUMENTS, delete the following duplicate reference entries:

"JP 2005157372 A 06/2005
JP 2006323343 A 11/2006
JP 2007-017938 A 1/2007
JP 200786741 A 4/2007
JP 2007140434 A 6/2007"

Signed and Sealed this
Fourth Day of June, 2013

Teresa Stanek Rea
*Acting Director of the United States Patent and Trademark Office*